US008156574B2

(12) United States Patent
Stokes et al.

(10) Patent No.: US 8,156,574 B2
(45) **Date of Patent: *Apr. 17, 2012**

(54) HELMET ADJUSTMENT SYSTEM

(75) Inventors: Peter L. Stokes, Boston, MA (US); David C. Rogers, Boston, MA (US); Duco W. Noordzij, Roxbury, MA (US)

(73) Assignee: Warrior Sports, Inc., Warren, MI (US)

( * ) Notice: Subject to any disclaimer, the term of this patent is extended or adjusted under 35 U.S.C. 154(b) by 1065 days.

This patent is subject to a terminal disclaimer.

(21) Appl. No.: 12/046,679

(22) Filed: Mar. 12, 2008

(65) Prior Publication Data

US 2008/0276354 A1 Nov. 13, 2008

Related U.S. Application Data

(60) Provisional application No. 60/916,606, filed on May 8, 2007.

(51) Int. Cl.
*A42B 1/22* (2006.01)

(52) U.S. Cl. ..... 2/420; 2/417; 2/418; 2/419; 2/425; 2/424

(58) Field of Classification Search ..... 2/417–420, 2/410, 455, 425, 424
See application file for complete search history.

(56) References Cited

U.S. PATENT DOCUMENTS

| | | | |
|---|---|---|---|
| 2,437,748 | A | 3/1948 | Malcom |
| 2,926,406 | A | 3/1960 | Edwards et al. |
| 3,214,809 | A | 11/1965 | Edwards |
| 3,325,824 | A | 6/1967 | Donegan |
| 3,329,968 | A | 7/1967 | Gordon |
| 3,696,440 | A | 10/1972 | Littleton |
| 4,539,715 | A | 9/1985 | Clement |
| 4,888,831 | A | 12/1989 | Oleson |
| 4,942,628 | A | 7/1990 | Freund |
| 5,175,889 | A | 1/1993 | Infusino |
| 5,271,103 | A | 12/1993 | Darnell |
| 5,331,687 | A | 7/1994 | Kronenberger |
| 5,511,250 | A | 4/1996 | Field et al. |
| 5,571,217 | A | 11/1996 | Del Bon et al. |
| 5,815,847 | A | 10/1998 | Holden, Jr. |
| 5,845,341 | A | 12/1998 | Barthold et al. |
| 5,893,174 | A | 4/1999 | Primeau |
| 5,950,245 | A | 9/1999 | Binduga |
| 5,953,761 | A | 9/1999 | Jurga et al. |
| 5,956,776 | A | 9/1999 | Chartrand |
| 6,032,297 | A | 3/2000 | Barthold et al. |
| 6,108,824 | A | 8/2000 | Fournier et al. |
| 6,154,889 | A | 12/2000 | Moore, III et al. |

(Continued)

*Primary Examiner* — Christopher Harmon
(74) *Attorney, Agent, or Firm* — Warner Norcross & Judd LLP

(57) ABSTRACT

A protective sport helmet, such as for lacrosse, includes a hard shell portion, a lining portion, and an adjustment mechanism. The inner side of the adjustment mechanism includes an adjustment protective pad. Together, the lining portion and the inner surface of the adjustment protective pad define an interior region of the helmet wherein the user's head is introduced. The adjustment mechanism includes a lower rear shell portion having a clutching mechanism that allows the user to manually adjust the size of the interior region via a strapping system of the helmet to couple snugly around the user's head. The clutching mechanism also prevents the interior region from being easily altered in the absence of manual adjustment to the adjustment mechanism. The strap includes a hard end material that engages the adjustment mechanism and a flexible, durable and tough material that conforms to a wearer's head.

35 Claims, 4 Drawing Sheets

U.S. PATENT DOCUMENTS

| | | | |
|---|---|---|---|
| 6,256,798 | B1 | 7/2001 | Egolf et al. |
| 6,298,497 | B1 | 10/2001 | Chartrand |
| 6,324,700 | B1 | 12/2001 | McDougall |
| 6,385,780 | B1 | 5/2002 | Racine |
| 6,647,556 | B2 | 11/2003 | Grepper et al. |
| 6,708,376 | B1 | 3/2004 | Landry |
| 6,865,752 | B2 | 3/2005 | Udelhofen et al. |
| 6,934,972 | B2 | 8/2005 | Desjardins et al. |
| 6,966,075 | B2 | 11/2005 | Racine |
| 6,968,575 | B2 | 11/2005 | Durocher |
| 6,981,284 | B2 | 1/2006 | Durocher |
| 7,000,262 | B2 | 2/2006 | Bielefeld |
| 7,043,772 | B2 | 5/2006 | Bielefeld et al. |
| 7,174,575 | B1 * | 2/2007 | Scherer ..... 2/418 |

* cited by examiner

HELMET ADJUSTMENT SYSTEM

CROSS REFERENCE TO RELATED APPLICATIONS

The present application claims priority from U.S. Provisional Application Ser. No. 60/916,606 filed on May 8, 2007, entitled "Helmet Adjustment System."

TECHNICAL FIELD

The present invention relates generally to sports protective helmets and more particularly to an adjustment system for sports protective helmets.

BACKGROUND OF THE INVENTION

Helmets for use in a variety of different sporting events, as well as for a variety of different recreational activities or non-recreational activities, are well known. The known primary purpose of these helmets is to protect a wearer's head from injury in the event that a force is directed thereat. Thus, a principal purpose of helmets is wearer safety. In fact, government and/or other standards exist that govern the performance of helmets intended for certain activities when subjected to certain forces.

Helmets used by those engaged in certain sports typically have a hard outer shell that covers some type of energy-absorbing material. The hard outer shell of most sport helmets is typically comprised of a plastic material. The outer shell typically covers an expanded inner layer that lies between the outer shell and the wearer's head. The inner layer is intended to absorb energy in the event it becomes necessary in order to minimize the energy transmitted to a wearer's head. Examples of known impact resistant materials used in the inner layer include single layer polymeric materials such as polystyrene or multiple layer polymeric materials. Alternatively, protection can be provided by a dense polyethylene outer shell that covers inner polypropylene pads capable of absorbing multiple impacts.

For non-recreational activities, the composition of the outer shell may vary. For example, the composition of the outer shell, when used for military purposes, is typically formed of polymeric or metallic material that is capable of resisting any type of ordnance, including ammunition for weapons as well as explosives or similar items. For example, one non-limiting example of a polymeric material that may form a portion of the composition of the outer shell is Kevlar®, manufactured and sold by E.I. duPont De Nemours and Company of Wilmington, Del. Alternatively, for a motorcycle helmet, the composition of the outer shell may be a hard, impact resistant polymer such as ABS (acrylonitrile-butadiene-styrene).

Regardless of the intended use, it is generally well known that current protective helmets do not provide a high degree of comfort. This is principally because the helmet itself and the inner lining are designed principally for safety purposes and not for comfort. As such they can be relatively heavy and cumbersome.

In addition, the methods for adjusting the helmet to the size of a wearer's head typically occur with adjustments in position to the outer plastic shell, and not to the inner liner. To adjust these helmets, a user typically is required to loosen adjustment screws and push or pull the outer shell manually to a desired position and retighten the adjustment screws. The helmet is then replaced onto the wearer's head to check the resizing. As one of ordinary skill appreciates, such a task is cumbersome and difficult to achieve the desired snug fit. Moreover, the sizing of the inner lining is not adjusted in these methods, thus precise fitting of the inner lining of the helmet to the wearer's head is not achieved, resulting in a loss of comfort to the wearer.

In alternative known helmets, the sizing of the helmet is achieved by changing the thickness of the foam padding contained within the inner lining. This is accomplished by replacing the inner lining completely or adding additional liner pads to existing liner configurations. The process for fitting the helmet precisely to a wearer's head, similar to the use of adjustment screws, is cumbersome. Also, it is difficult to achieve an appropriate snug fit that provides the necessary stability of the helmet on a user's head. The process is no simpler in systems that utilize adjustment screws and allow the changing of inner lining padding.

In still other helmets, the adjustment of the sizing of the helmet to the user's head is achieved through the use of straps. The straps are secured to the outer shell and one or more location and are adjusted in a wide variety of ways. The straps are typically either formed from a flexible plastic material or of a flexible non-polymeric material such as leather or the like. Each of these materials has drawbacks. For example, a hard but flexible plastic strap does not provide a high degree of comfort to a user, especially in areas wherein the strap directly contacts a user's head. Leather straps provide such a comfort, but do not provide the desired durability characteristics, especially at points wherein the strap is fastened to the outer shell.

It would thus be desirable to provide a helmet that provides an appropriate balance between wearer safety and wearer comfort. It is also desirable that such a helmet is easily adjustable.

SUMMARY OF THE INVENTION

It is therefore an advantage of the present invention to provide a protective helmet that cushions a wearer's head against blows thereto.

It is another advantage of the present invention to provide a protective helmet that is durable and lightweight.

It is still another advantage of the present invention to provide a protective helmet that is easily adjustable to provide improved fit on a wearer's head.

It is still another advantage of the present invention to provide an adjustable protective helmet wherein the helmet remains properly positioned on a wearer's head during use.

It is still another advantage of the present invention to provide an adjustable protective helmet that utilizes a strap adjustment system that is both durable and comfortable.

In accordance with the above and other advantages, the present invention provides a protective helmet that addresses some of the deficiencies described above.

In a preferred embodiment of the present invention, the protective helmet includes an outer shell that is made of a relatively thick rigid material, such as plastic. The helmet includes a liner disposed on the inner surface of the shell. The helmet may also include a facemask or cage that is secured to the shell as well as a chinstrap that is intended to assist in retaining the helmet on a wearer's head.

The protective helmet also has an adjustment mechanism that allows the size and/or tightness of the inner lining of the helmet to be adjusted. In general, the adjustment mechanism includes a lower rear shell portion that is disposed beneath the rear portion of the outer shell. The lower rear shell portion is moveable with respect to the rear portion of the outer shell through the use of the adjustment mechanism. The lower rear shell portion is attached at either end to at least one strap that is secured to an inner surface of the outer shell. The strap consists of a hard portion that is coupled within the adjustment mechanism and a flexible, tough, durable portion that is disposed within the liner of the helmet and conforms to a wearer's head. The lower rear shell portion includes an adjustment knob to effectuate adjustment of the helmet fit. When the adjustment knob is rotated in one direction, the at least one strap is tightened, causing the lower rear shell portion to move inwardly to make the size of the head opening smaller and thus tighten the fit of the helmet. Similarly, when the adjustment knob is rotated in the other direction, the at least one strap is loosened, therein causing the lower rear shell portion to move outwardly and increase the size of the headroom in the helmet.

The adjustment knob includes a clutch mechanism that applies pressure to a coil spring to move it away from a clutch tube in order to easily rotate the knob clockwise or counterclockwise to tighten or loosen the fit of the helmet as desired. In the absence of applied pressure to the adjustment knob, the coil spring is coupled against a clutch tube, therein making it more difficult to tighten or loosen the fit of the helmet. Thus, in the absence of pressure applied directly to the adjustment knob, the inner lining of the helmet is maintained in a proper fitted position for maximum protection to the head against jarring impacts common in contact sports.

Other advantages of the present invention will become apparent when viewed in light of the detailed description of the preferred embodiment when taken in conjunction with the attached drawings and appended claims.

DETAILED DESCRIPTION OF THE PREFERRED EMBODIMENT

Referring to the Figures, a protective helmet 10 in accordance with one preferred embodiment the present invention is illustrated. The protective helmet illustrated in the Figures is intended for use in the game of lacrosse. However, it will be understood that the helmet 10 of the present invention may be utilized in or adapted for use in a variety of other sports, including field hockey, ice hockey or other sports where protection for a wearer's head is desired or required. Moreover, it will be further understood that the disclosed protective helmet 10 can be utilized in or adapted for use in a variety of other activities, including recreational activities or other activities, where protection for a wearer's head is desired or required.

Figure 1:
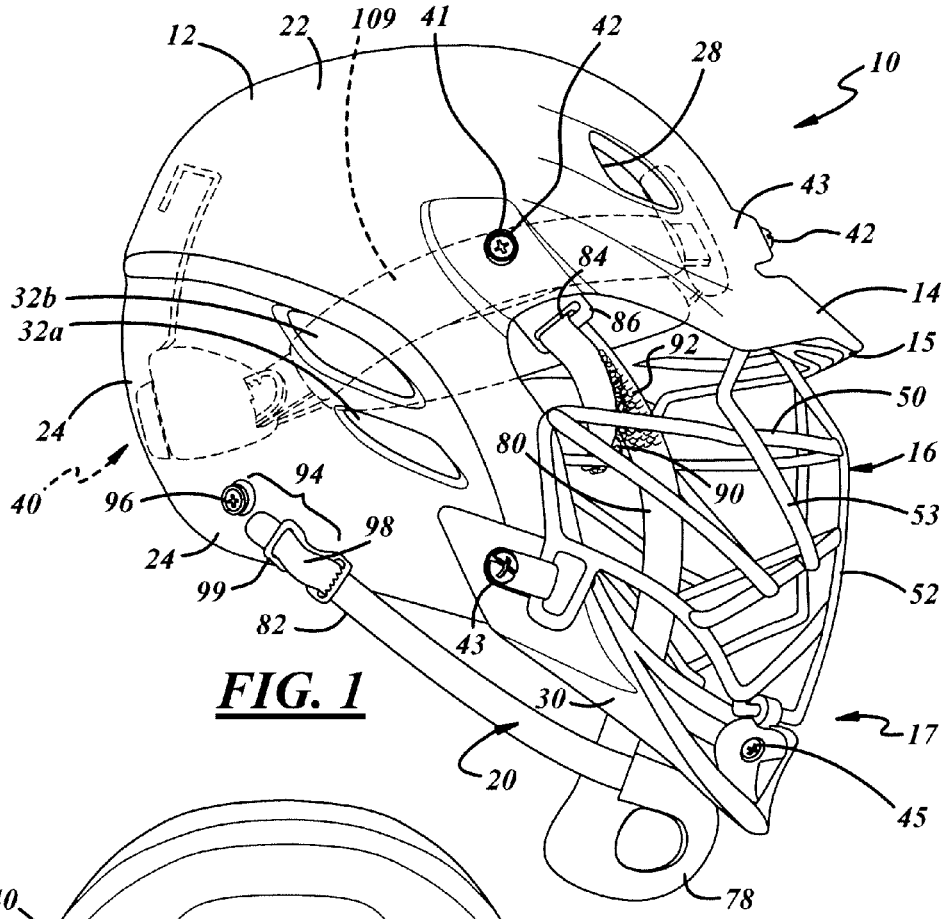
FIG. 1 is a side view from the right of a protective sports helmet having an adjustment mechanism in accordance with one embodiment of the present invention.
Figure 2:
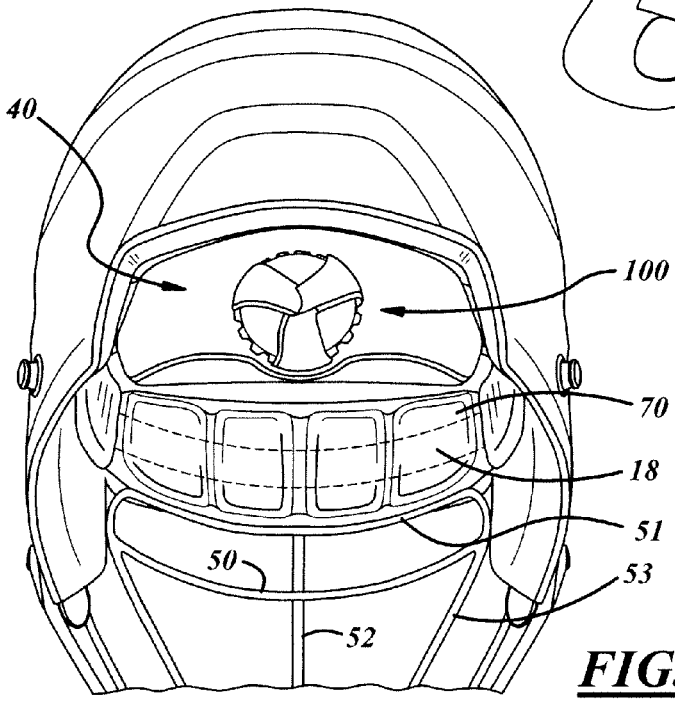
FIG. 2 is a rear view of the protective sports helmet of FIG. 1.
Figure 3:
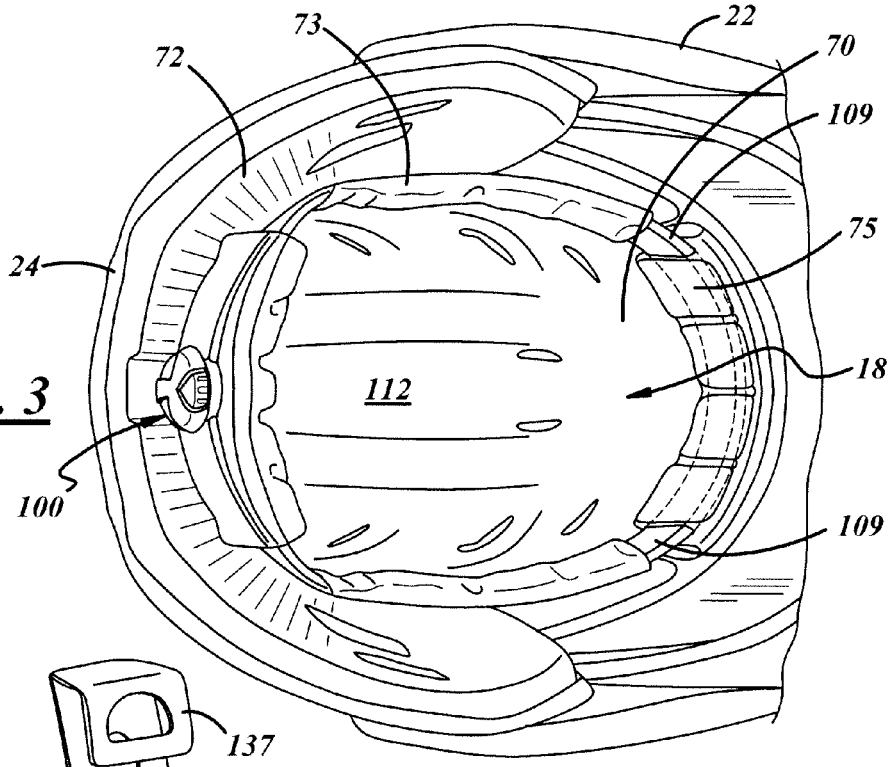
FIG. 3 is a bottom view illustrating the interior of the protective sports helmet of FIG. 1.

Referring to FIGS. 1 through 3, a protective helmet 10 in accordance with a preferred embodiment of the present invention is illustrated. The protective helmet 10 includes an outer shell 12, a visor portion 14, a facemask portion 16, an inner lining 18, a chinstrap portion 20, a facemask extension piece 30, and an adjustment mechanism 100 including a lower rear shell portion 40 that is disposed beneath the rear portion of the outer shell 12.

The outer shell 12 is preferably integrally formed as a single unitary piece or is alternatively formed from a number of pieces coupled together to form an integral unit. The outer shell 12 is preferably constructed of a hard plastic material and is formed from conventional injection molding process. In one embodiment, the outer shell 12 is preferably formed of polyurethane. It will be understood that the outer shell 12 may be comprised of a variety of other materials and may be formed from other processes. However, the outer shell 12 must be formed of a material and by a process that provides sufficient hardness and force resistant characteristics, as would be understood by one of ordinary skill in the art.

The outer shell 12 preferably has an upper crown portion 22 and a lower portion 24. The upper crown portion 22 is intended to cover the crown of a wearer's head, while the lower portion 24 is intended to cover the upper back and sides of a wearer's head. The exact configuration of the shape of the upper crown portion 22 and the lower crown portion 24 is not limited to the shapes shown and described herein, but is a matter of design choice and is thus not a critical part of the invention. Moreover, the relative thickness of the regions of the upper crown portion 22 and the lower portion 24 may vary and are not limited by the disclosed design herein.

The upper crown portion 22 also preferably includes a plurality of vent openings 28 formed therein to allow air to circulate to a wearer's head. The location and configuration of the vent openings 28, as well as the number of openings and groupings thereof, is a matter of design choice and is thus not a critical part of the invention.

The lower portion 24 of the helmet 10 also has one or more ear holes, here shown as ear holes 32*a* and 32*b*, formed in either side thereof. The ear holes 32*a* and 32*b* allow for increased communication on the field as well as for increased ventilation to the wearer's head. The number and size of the ear holes 32*a*, 32*b* may vary as a matter of design choice and are thus not a critical part of the invention.

The facemask extension piece 30 is coupled to the lower portion 24 of the helmet 10 on either side thereof using one or more set screws 43 at a location near the ear holes 32*a*, 32*b*. The facemask extension piece 30 provides increased protection to the throat and chin of the wearer during play. It will also be understood that the facemask extension piece 30 can be eliminated from the helmet entirely or can be attached to the shell 12 at a variety of different locations or by a variety of attachment mechanisms.

The visor portion 14 of the helmet 10 is preferably a separate piece that is attached to the upper crown portion 22 at two or more attachment points 42. It will be understood that more or less attachment points 42 may be incorporated into the helmet 10. Moreover, the visor portion 14 may take on a variety of different configurations. Alternatively, the visor portion 14 may be integrally formed with the upper crown portion 22. The visor portion 14 is preferably also formed of a plastic material, but is preferably formed from compression molding techniques. It will be understood that the visor portion 14 may be formed from other materials and by other processes.

The facemask or cage portion 16 of the helmet 10 is intended to cover the front opening of the helmet 10 and protect a wearer's face. The facemask portion 16 includes a plurality of horizontal bars 50 and a plurality of vertical bars 52 and may also include a plurality of non-vertical and non-horizontal bars 53. The horizontal bars 50, the vertical bars 52, and the non-vertical and non-horizontal bars 53 form a plurality of openings 54 therein to allow line of sight for a wearer of the helmet 10. The facemask portion 16 is preferably constructed of a metal, however, it may be constructed of a variety of other suitable materials. The facemask portion 16 is coupled such that the uppermost horizontal bar 51 is generally planar and almost contacts the bottom portion 15 of the forwardly extending visor portion 14. In one embodiment, the uppermost horizontal bar 51 is secured to the underside 15 of the visor portion 14. This provides additional safety for the wearer of the helmet 10. A mounting screw or screws 41 or similar type mounting device couples the facemask portion 16 to both the visor portion 14 and the upper crown portion 22.

As can be seen, the facemask portion 16 has an outermost portion that is disposed outwardly (forwardly away from a wearer's face) with respect to the visor portion 14. This will assist in preventing any of the wearer's equipment from getting caught in the visor portion 14.

The facemask portion 16 is preferably attached along its lower portion 17 to the facemask extension piece 30 using one or more screws 45 and is also preferably coupled to both the facemask extension piece 30 and the lower portion 24 of the shell 12 using additional setting screws 43. Other suitable securing mechanisms may also be utilized, as will be understood by one of ordinary skill in the art.

The helmet 10 also includes a chinstrap portion 20, which is preferably comprised of a chin guard 78 coupled to a plurality of chinstraps 80, 82 that attach to portions of the helmet 10 to allow the chin guard 78 to fit snugly against a wearer's chin during play and assist in the fit of the helmet 10.

Each of the first set of chinstraps 80 are preferably looped through an opening 84 in a metal coupler 86 that is attached to the visor portion 14 and the upper crown portion 22 with the screw 41. The first set of chinstraps 82 include a pair of sewn on hook and loop fastening strips 90, 92 that are coupled together to secure the first set of chinstraps 90 in a desired arrangement.

The second set of chinstraps 82 are preferably coupled to the chin guard 78 and are attached to the lower portion 24 of the helmet 10 using a snap fastener device 94 or other attachment mechanism. The snap fastener device 94 includes a male portion 96 and female portion 98. As shown herein, the male portion 96 is coupled to the lower portion 24 of the helmet 10 while the female portion 98 is looped onto the respective ends 99 of the second set of chinstraps 82. Alternatively, of course, the reverse arrangement is contemplated, wherein the female portion 98 is coupled to the lower portion 24 and the male portion 96 is looped onto the ends 99 of the straps 82.

As one of ordinary skill in the art will recognize, the adjustment of the chinstrap portion 20 may thus be accomplished by adjusting the attachment of the hook and loop fastening strips 90, 92 and further by adjusting the location of the female portion 98 of the snap fastener device 94 on the ends 99 of the straps 82.

The inner lining 18 may take on many forms well known to those of ordinary skill in the art of sports helmet manufacturing. The inner lining 18 has many functions. First, it provides a snug fit to a wearer's head, while providing comfort in the form of a non-abrasive smooth inner surface directly contacting the skin. Second, the composition of the inner lining 18, in conjunction with the hard outer shell 12, provides protection against impacting blows during play. In addition, it is desirable that the material used in the inner lining 18 is moisture resistant and/or includes a wicking material. The inner lining 18 can have various thicknesses and can have portions removable or interchangeable.

As best shown in FIG. 3, the inner lining 18 preferably includes a crown lining portion 70 and a lower liner portion 72. The crown lining portion 70 is preferably attached to the upper crown portion 22 of the outer shell 12, while the lower liner portion 72 is attached to the lower portion 24 of the outer shell 12. The crown lining portion 70 preferably extends around the venting openings 28 leaving them exposed to provide access for cooling airflow to the wearer's head.

The lower liner portion 72 is preferably secured to the portion of the helmet 10 corresponding to the lower portion 24. The lower liner portion 72 preferably extends around the cut out ear holes 32*a* and 32*b* leaving them exposed in order to provide access for sound to the wearer's ear.

FIGS. 4 through 6C illustrate the adjustment mechanism 100, as well as the method for adjusting the sizing of the lower rear shell portion 40 using the adjustment mechanism 100, in more detail.

Figure 4:
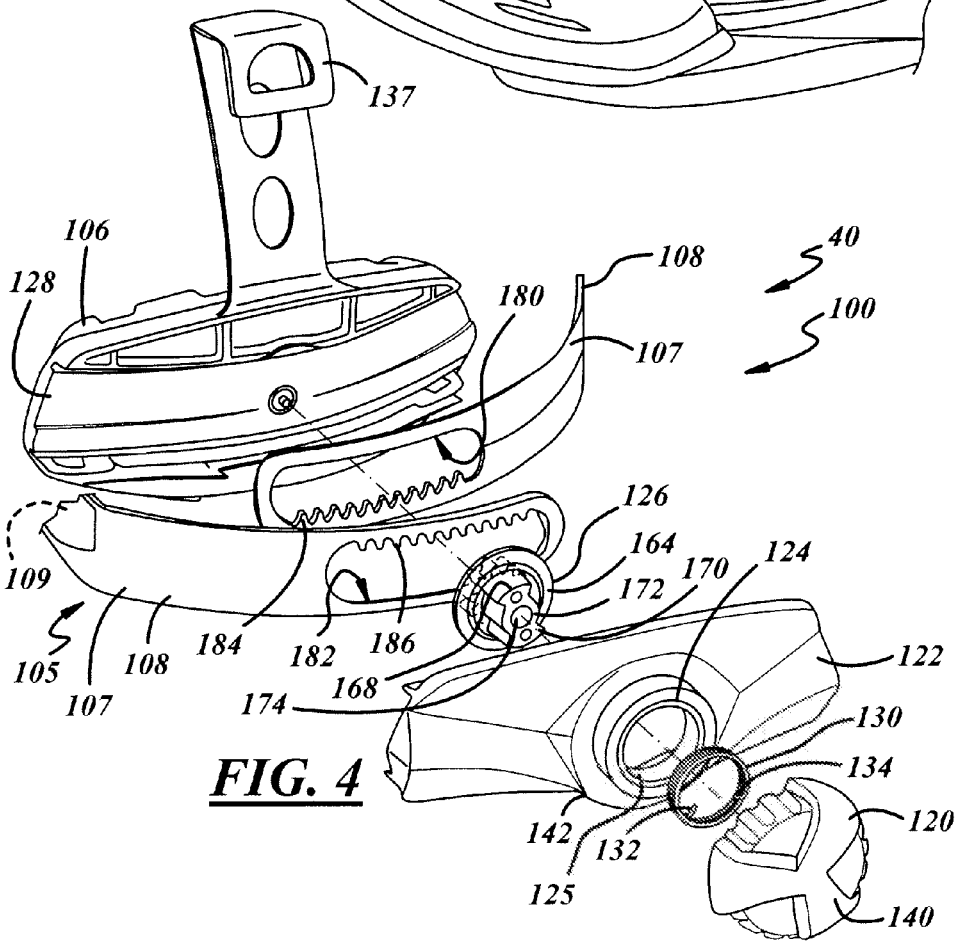
FIG. 4 is an exploded view of an adjustment mechanism for a protective sports helmet in accordance with one embodiment of the present invention.
Figure 5:
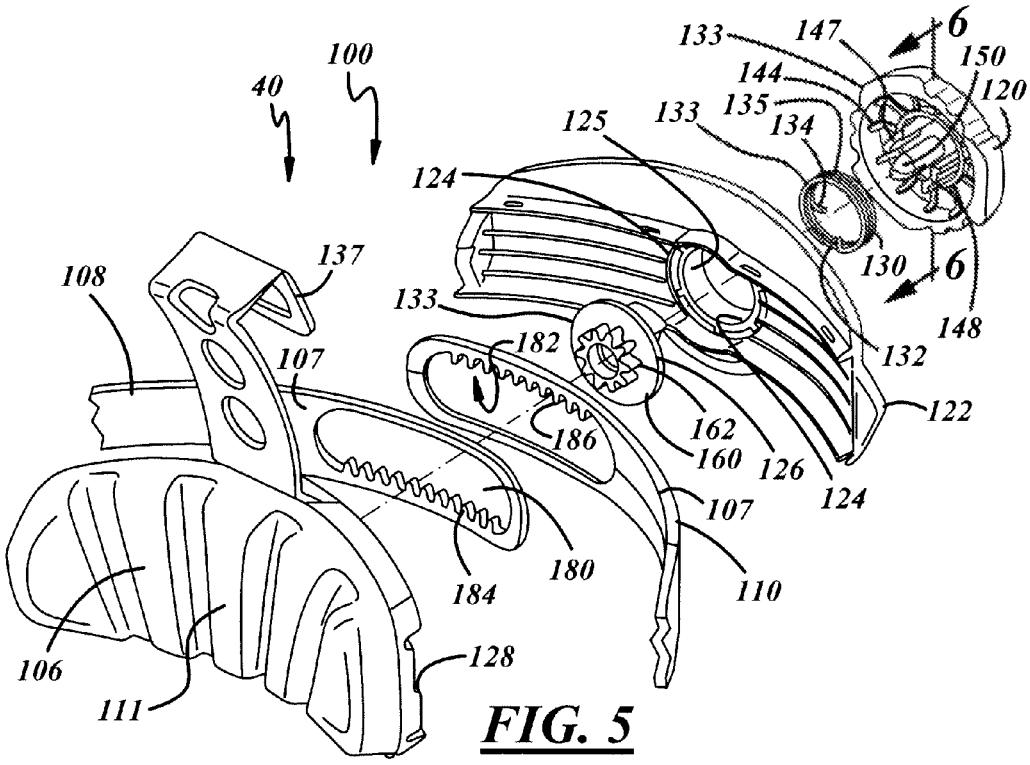
FIG. 5 is another exploded view of the adjustment mechanism shown in FIG. 4.

Referring first to FIGS. 4 and 5, the adjustment mechanism 100 is shown in exploded view as having lower rear shell portion 40 that includes an adjustment knob 120, an adjustment outer housing 122 including a clutch tube 124, a pinion 126, a strap 107 having a first end 108 and a second end 110, an adjustment inner housing 128, an adjustment mounting pad 106 coupled to the adjustment inner housing 128, and a coil spring 130 including a pair of tines 132, 134 coupled at either end of a middle region 135. The middle region 135 is coupled within and engageable with the outer surface 125 of the clutch tube 124, which is slightly smaller than the spring free diameter of the coil spring 130. As best shown in FIGS. 1 and 4, the adjustment inner housing 128 includes a flanged region 137 that is preferably coupled between the upper crown portion 22 and the crown lining portion 70 of the helmet 10 when the adjustment mechanism 100 is fully assembled. Alternatively, the flanged region 137 could be coupled between the lower liner portion 72 and the lower portion 24 and still fall within the spirit of the present invention.

The adjustment knob 120 includes an outer portion 140 coupled to one side 142 of the adjustment outer housing 122 and an inner portion 144 coupled within the other side of the adjustment outer housing 122. The inner portion 144 includes a pair of flanges 147, 148 and an inner guide portion 150. Collectively, the pinion 126, the adjustment knob 120, and the coil spring 130 define a clutch mechanism 133.

The pinion 126 has a first side 160 having a plurality of teeth 162 and a second side 164 having a pair of regions 168, 170, with the regions 168, 170 corresponding in size and shape to the flanges 147, 148 and being adjacent thereto for communication therewith when the adjustment mechanism 100 is fully assembled. A central circular region 172 sized to correspond to the interior opening 125 of the clutch tube 124. The pinion 126 includes a central opening 174 sized to receive the inner guide portion 150 of the adjustment knob 120.

The strap 107 includes a middle portion 109 extending between the respective first end 108 and second end 110. The middle portion 109 of the strap 107 between the ends 108, 110 is coupled within a sleeve 73 of the lower liner portion 72 and a sleeve 75 contained within the crown lining portion 70. The middle portion 109 is formed of a flexible, durable, tough material such as high density polypropylene (HDPP) or high density polyethylene (HDPE) that allows the helmet to easily conform to a wearer's head, as will be described in further detail below.

The ends 108, 110 of the strap 107 are feathered within an inner region 105 defined between the adjustment inner housing 128 and the adjustment outer housing 122. The ends 108, 110 each have an open middle portion 180, 182 having a plurality of teeth 184, 186 that correspond to the teeth 18 of the pinion 126. The ends 108, 110 of the strap 107 are formed of a harder material, such as nylon or acetal, than the middle portion 109 to protect the teeth 184, 186 from breakage as the adjustment knob 120 is rotated to tighten or loosen the strap 107. The ends 108, 110 of the strap 107 are coupled to the middle portion 109 by gluing, riveting or some other securing mechanism that has sufficient strength and durability to withstand the rigors of use.

The inner surface 111 of the adjustment mounting pad 106 and the inner surface 113 of the lower liner portion 72 define the interior region 112. The size of the interior region 112 may be adjusted using the adjustment mechanism 100 to increase the size of the interior region 112 when it is being removed or placed onto wearer's head and decrease the size of the interior region 112 during play such that the inner surfaces 111, 113 fit snugly to the wearer's head during play. The mechanism for increasing and decreasing the size of the interior region 112 is described below.

Figure 6A:
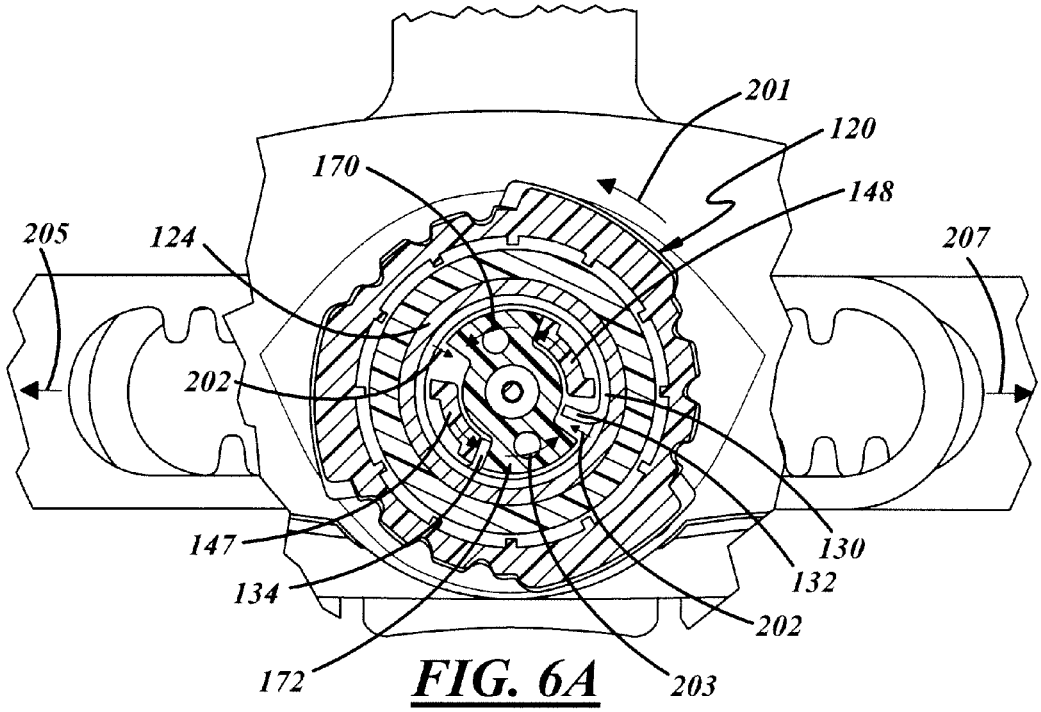
FIG. 6A is a sectional view of the adjustment knob of FIG. 5 taken along line 6-6 illustrating the operation of the adjustment mechanism when the adjustment knob is being rotated in a first direction.
Figure 6B:
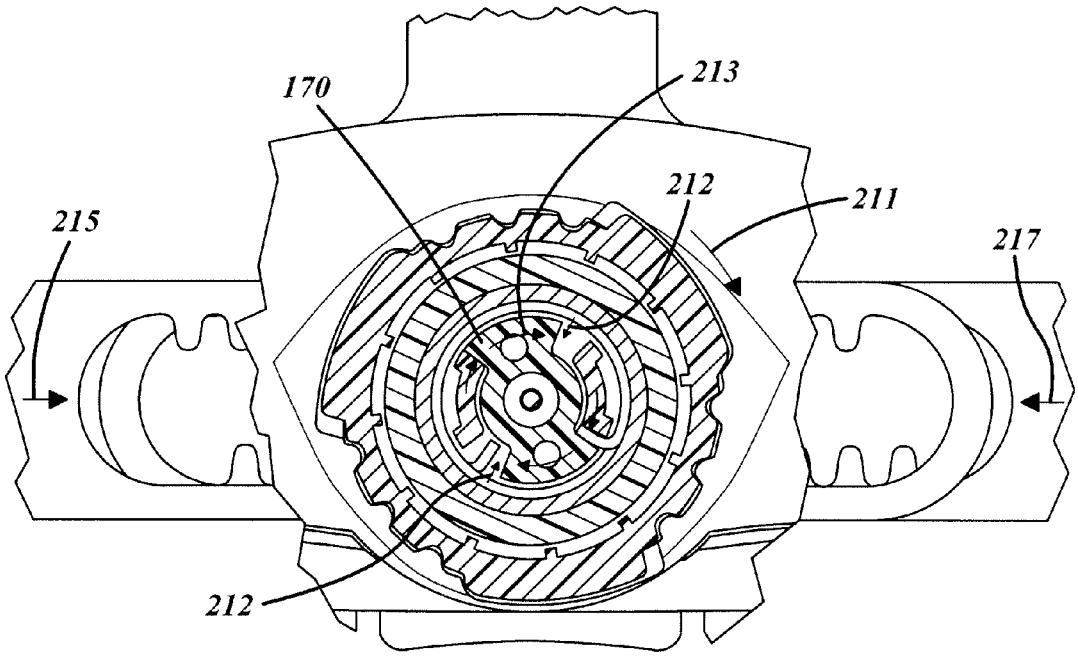
FIG. 6B is a sectional view of the adjustment knob of FIG. 5 taken along line 6-6 illustrating the operation of the adjustment mechanism when the adjustment knob is being rotated in a second direction.
Figure 6C:
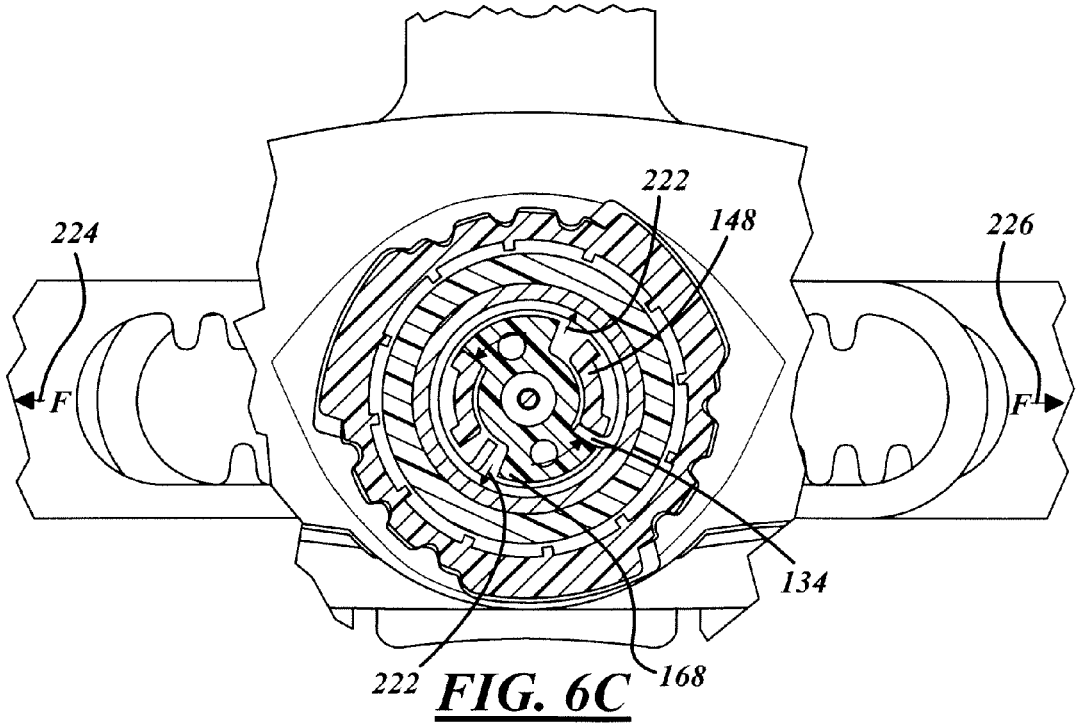
FIG. 6C is a sectional view of the adjustment knob of FIG. 5 taken along line 6-6 illustrating the operation of the adjustment mechanism when the adjustment knob is locked in a closed position.

FIGS. 6A and 6B below illustrate how the preferred method for adjusting the size of the interior region 112 to attain a desired fit to a wearer's head, wherein the wearer manually engages the adjustment mechanism 100 to release the clutch mechanism to move the lower rear shell portion 40 relative to the to the facemask portion 16. In the absence of manual engagement of the adjustment mechanism, as shown in FIG. 6C, the clutch mechanism is locked or otherwise disengaged, and thus substantially prevents the size of the interior region 112 (i.e. relative movement of the lower rear shell portion 40) to be altered such as by an impacting blow, therein maintaining the desired fit of the interior region 112 around the user's head during play.

To decrease the size of the interior region 112, as shown best in FIG. 6A, a wearer simply rotates the adjustment knob 120 in a first direction, indicated by arrow 201 as counterclockwise. The rotation of the adjustment knob 120 causes the flange 147 to contact the spring tine 132, which causes the coil spring 130 to coil more tightly and pull inwardly away from the clutch tube 124, as shown by arrow 202. At the same time, the second flange 148 contacts region 170 of the pinion 126, causing it to rotate in the first direction as well, again shown as counterclockwise by arrow 203. The rotation of the pinion 126 in the first direction causes the teeth 162 to rotate as well. The rotation of the teeth 162, which are enmeshed (i.e. engaged) with the corresponding teeth 184, 186 of the ends 108, 100 of the strap 107, causes the ends 108, 110 of the strap 107 to move opposite one another, as shown by respective arrows 205, 207 such that the lower rear shell portion 40, and more specifically the adjustment inner housing 128 and the adjustment mounting pad 106, is pulled inwardly towards the facemask portion 16, therein decreasing the diameter or size of the interior region 112 to tighten the interior region 112 against the wearer's head. At the same time, the middle portion 109 of the strap 107 is also being pulled taut within the sleeves 73, 75, thus moving the lower liner portion 72 inward slightly towards the wearer's head. As the middle portion 109 of the strap 107 is flexible, it therefore comfortably conforms to the wearer's head as it is tightened. This results in the interior region 112 providing a snugger and properly positioned fit around the wearer's head.

Conversely, to increase the size of the interior region 112, as shown best in FIG. 6B, a wearer simply rotates the adjustment knob 120 in a second direction, shown by arrow 211. The second direction is opposite of the first direction, here shown as clockwise.

The rotation of the adjustment knob 120 causes the second flange 148 to engage and push against the spring tine 134, which similarly causes the coil spring 130 to coil more tightly and move away from the clutch tube 124. This is shown by arrow 212.

The first flange 147, at the same time, engages and pushes against region 170 of the pinion 126, causing it to rotate in the second direction as well. This is shown by arrow 213. The rotation of the pinion 126 in the second direction causes the teeth 162 to rotate as well. The rotation of the teeth 162, which are enmeshed (i.e. engaged) with the corresponding teeth 184, 186 of the ends 108, 110 of the strap, causes the ends 108, 110 of the strap 107 to move towards one another, as shown by the respective arrows 215, 217, such that the lower rear shell portion 40, and more specifically the adjustment inner housing 128 and the adjustment mounting pad 106, is pulled outwardly away the facemask portion 16, therein increasing the diameter of the interior region 112 to loosen the interior region 112 with respect to the wearer's head. At the same time, the middle portion 109 of the strap 107 is also being loosened within the sleeves 73, 75, thus moving the lower liner portion 72 outward slightly away from the wearer's head.

Referring now to FIG. 6C, another aspect of the present invention is shown wherein the wearer has previously adjusted the helmet 10 to a desired interior region 112 sizing. Thus, in the example provided, there is no manual rotational force being applied to the adjustment knob 120 by the wearer. This is the so-called disengaged position.

In the absence of one or the other of the flanges 147, 148 contacting the respective spring tine 132, 132, the coil spring 130 is maintained in its natural loaded position. In this position, the coil spring 130 is uncoiled and contacts the outer surface 125 of the clutch tube 124 with a force shown by arrow 222.

In FIG. 6C, a force has been applied to the strap 107 as shown by arrows 224, 226, without contacting the adjustment knob 120, such as when the helmet 10 is contacted during play by an impacting blow. When this occurs, the region 168 of the pinion 126 is pushed against spring tine 134 in such a way that the coil spring 130 uncoils and is expanded against the clutch tube 124, therein substantially preventing further rotation of the pinion 126 to move the ends 108, 110 of the strap 107 in the direction of arrows 224, 226. Thus, the size of the interior region 112 (i.e. the lower rear shell portion 40 cannot easily move relative to the facemask portion 16) is substantially maintained in its desired setting even if force is applied to the ends 108,110 of the strap 107. As such, the helmet 10 remains tightly coupled around the wearer's head in its desired sizing even if the wearer's head is contacted with an impacting blow. This protects the wearer's head from subsequent blows that could result in injury as in the prior art if the interior region 112 was loosened or otherwise altered relative to the wearer's head. Thus, the clutching mechanism 133 acts to "lock" the size of the interior region 112 in the absence of the wearer manually rotating the adjustment knob 120, therein providing extra protection to the wearer versus prior art strapping mechanism without such a locking feature.

In an alternative preferred embodiment (not shown), the strap 107 may actually consist of two straps and still fall within the spirit of the present invention. In this alternative arrangement, one end of each of the respective straps corresponds in location and function to ends 108, 110, of strap 107, while the other end of each of the straps terminates or is attached to either the crown lining portion 70 or the lower lining portion 72, as opposed to the arrangement wherein the middle portion 109 of the strap 107 is coupled within a sleeve 73 of the lover liner portion 72 and a sleeve 75 of the crown lining portion 70. The mechanism for tightening or loosening the straps is exactly as described with respect to one strap 107 as described in FIGS. 6A and 6B above, wherein the rotation of the adjustment knob 120 in the first or second direction causes the movement of the strap ends 108, 110 to move either towards one another or away from one another, such that the lower rear shell portion 40 is pulled inwardly or pushed outwardly to change the diameter or size of the interior region 112. As with the single strap 107, each end of the multiple straps engaging the adjustment mechanism is preferably formed of a hard plastic material, while the opposite ends not engaged to the adjustment mechanism are preferably formed of a flexible, durable and tough material that easily and comfortably conforms to a wearer's head.

The present invention thus provides a simple mechanism for manually adjusting the interior region 112 of a protective sports helmet 10 to properly fit a wearer's head after it is introduced to the protective sports helmet 10. The adjustment mechanism 100 also allows the interior region 112 size to be increased after usage to allow the head to be easily removed from the helmet 10.

The clutching mechanism 133 of the present invention also substantially prevents the interior region 112 size for being altered in the absence of direct manual adjustment pressure to the adjustment knob 120. This aids in preventing the fit of the helmet 10 to be adjusted accidentally during play, thus providing increased safety to the wearer.

The present invention is ideally suited for use in a wide variety of protective sports helmets, including specifically lacrosse helmets as displayed herein. However, the present invention may be used in any other type of protective sports helmet in which a snug fit around the wearer's head is desired, including but not limited to ice hockey, roller hockey, motocross, bike racing, skateboarding, and skiing, for example. In addition, the protective helmet may also find application in other hobbies utilizing protective helmets, including bike riding and motorcycle riding. Moreover, the helmet including the adjustment mechanism of the present invention may find use in heavier, more protective helmet applications, such as, for example, for use in military or police helmets.

Finally, other headgear may incorporate the adjustment mechanism of the present invention to provide a stable and secure fit to a wearer, regardless of the application. For example, the adjustment mechanism may find application in use for such things as head-held cameras, headphones, and the like.

While particular embodiments of the invention have been shown and described, numerous variations and alternate embodiments will occur to those skilled in the art. Accordingly, it is intended that the invention be limited only in terms of the appended claims.

What is claimed is:

1. A protective helmet, comprising:

a hard shell portion for covering and providing protection to a wearer's head;

a lining secured to an inner side of said hard shell portion; and an adjustment mechanism coupled to said hard shell portion, said adjustment mechanism including a clutch mechanism and an adjustment mounting pad, wherein an inner surface of said lining and an inner surface of said adjustment mounting pad define an interior region;

wherein said clutch mechanism includes an adjustment knob that is manually engageable to adjust a size of said interior region;

wherein said clutch mechanism substantially prevents the adjustment of said size of said interior region in the absence of said manual engagement;

wherein said clutch mechanism includes a coil spring, a clutch element and a pinion, the coil spring including a diameter, wherein manual rotation of the adjustment knob engages a portion of the coil spring so that the coil spring diameter changes, wherein the changing of the coil spring diameter causes the coil spring to move away from, and disengage from, the clutch element thereby enabling the adjustment knob to rotate the pinion and adjust the size of the interior region.

2. A protective helmet, comprising:

a hard shell portion for covering and providing protection to a wearer's head;

a lining secured to an inner side of said hard shell portion; and an adjustment mechanism comprising a lower rear shell portion coupled to said hard shell portion, said lower rear portion including an adjustment outer housing having a clutch mechanism and an inner housing having an adjustment mounting pad, wherein an inner surface of said lining and an inner surface of said adjustment mounting pad define an interior region;

wherein said clutch mechanism is manually engageable to adjust a size of said interior region;

wherein said clutch mechanism substantially prevents the adjustment of said size of said interior region in the absence of said manual engagement;

wherein said clutch mechanism comprises:

a coil spring coupled within an outer surface of a clutch tube of said adjustment outer housing, said coil spring including middle region located between a first spring tine and a second spring tine, said coil spring having a free diameter slightly larger than said outer surface of said clutch tube;

an adjustment knob coupled to said adjustment outer housing, said adjustment knob including a first flange and a second flange, said first flange engageable with said first spring tine and said second flange engageable with said second spring tine, wherein said adjustment knob is rotatable in a first direction and a second direction, said first direction opposite said second direction;

a pinion coupled between said adjustment outer housing and said inner housing and coupled to said adjustment knob, said pinion including a plurality of teeth and a pair of regions, one of said regions engageable with said first spring tine and an other of said pair of regions engageable with said second spring tine;

a strap having a middle portion, a first end and a second end, wherein said middle portion of said strap is coupled to said hard shell portion or to said lining;

wherein said first end and said second end each have an open middle region including a plurality of teeth, wherein each of said plurality of teeth of each of said first end and said second end is engaged with a corresponding one of said plurality of teeth of said pinion;

wherein the rotation of said adjustment knob in said first direction causes said first flange to contact said first spring tine to coil said coil spring away from said clutch tube, therein allowing said second flange to contact said one of said regions to move said region in a first direction, wherein the rotation of said one of said regions in said first direction causes said plurality of teeth of said pinion to rotate in said first direction, therein causing said first end of said strap and said second end of said strap to move opposite one another and away from said pinion, therein causing said lower rear shell portion to move such that said size of said interior region is decreased; and wherein the rotation of said adjustment knob in said second direction causes said second flange to contact said second spring tine to coil said coil spring away from said clutch tube, therein allowing said second flange to contact said other of said regions to move said other of said regions in a first direction, wherein the rotation of said other of said regions in said second direction causes said plurality of teeth of said pinion to rotate in said second direction, therein causing said first end of said strap and said second end of said strap to move opposite one another and towards from said pinion, therein causing said lower rear shell portion to move such that said size of said interior region is increased.

3. The protective helmet of claim 2, wherein said first direction is clockwise and wherein said second direction is counterclockwise.

4. The protective helmet of claim 2, wherein said first direction is counterclockwise and wherein said second direction is clockwise.

5. The protective helmet of claim 2, wherein said middle portion of said strap is coupled within a sleeve located within said lining of said hard shell portion.

6. The protective helmet of claim 1, wherein said clutch mechanism comprises:

a coil spring coupled within an outer surface of a clutch tube of said adjustment outer housing, said coil spring including middle region located between a first spring tine and a second spring tine, said coil spring having a free diameter slightly larger than said outer surface of said clutch tube;

an adjustment knob coupled to said adjustment outer housing, said adjustment knob including a first flange and a second flange, said first flange engageable with said first spring tine and said second flange engageable with said second spring tine, wherein said adjustment knob is rotatable in a first direction and a second direction, said first direction opposite said second direction;

a pinion coupled between said adjustment outer housing and said inner housing and coupled to said adjustment knob, said pinion including a plurality of teeth and a pair of regions, one of said regions engageable with said first spring tine and an other of said pair of regions engageable with said second spring tine;

a first strap having a first end and a second strap having a second end, said first strap and said second strap each being coupled to said hard shell portion or to said lining;

wherein said first end and said second end each having an open middle region including a plurality of teeth, wherein each of said plurality of teeth of each of said first end and said second end is engaged with a corresponding one of said plurality of teeth of said pinion;

wherein the rotation of said adjustment knob in said first direction causes said first flange to contact said first spring tine to coil said coil spring away from said clutch tube, therein allowing said second flange to contact said one of said regions to move said region in a first direction, wherein the rotation of said one of said regions in said first direction causes said plurality of teeth of said pinion to rotate in said first direction, therein causing said first end of said first strap and said second end of said second strap to move opposite one another and away from said pinion, therein causing said lower rear shell portion to move such that said size of said interior region is decreased; and wherein the rotation of said adjustment knob in said second direction causes said second flange to contact said second spring tine to coil said coil spring away from said clutch tube, therein allowing said second flange to contact said other of said regions to move said other of said regions in a first direction, wherein the rotation of said other of said regions in said second direction causes said plurality of teeth of said pinion to rotate in said second direction, therein causing said first end of said first strap and said second end of said second strap to move opposite one another and towards from said pinion, therein causing said lower rear shell portion to move such that said size of said interior region is increased.

7. The protective helmet of claim 6, wherein said first direction is clockwise and wherein said second direction is counterclockwise.

8. The protective helmet of claim 6, wherein said first direction is counterclockwise and wherein said second direction is clockwise.

9. The protective helmet of claim 6, wherein said first strap and said second strap are each coupled within a sleeve located within said lining of said hard shell portion.

10. The protective helmet of claim 1, wherein said inner housing includes a flanged region that is coupled between said lining and said outer shell.

11. The protective helmet of claim 2, wherein said first flange and said second flange of said adjustment knob are coupled with said pair of regions between said inner housing and said adjustment outer housing.

12. The protective helmet of claim 1, further comprising:

a facemask coupled to said hard shell portion.

13. The protective helmet of claim 12 further comprising:

a visor portion coupled to said hard shell portion and to said facemask.

14. The protective helmet of claim 12 further comprising:

a facemask extension portion coupled to said hard shell portion and to said facemask.

15. The protective helmet of claim 1 comprising a strap operably joined with said adjustment mechanism wherein a middle portion of said strap is formed of a flexible, durable tough material; and wherein an end of said strap is formed of a second material having sufficient hardness to resist breakage associated with engagement of said adjustment mechanism.

16. The protective helmet of claim 15, wherein said flexible, durable tough material is selected from the group consisting of high density polypropylene and high density polyethylene.

17. The protective helmet of claim 15, wherein said second material is selected from the group consisting of nylon and acetal.

18. An adjustment mechanism for a helmet comprising:

a lower rear shell portion including:

a. an inner housing having an adjustment mounting pad;

b. an adjustment outer housing coupled to said inner housing, said adjustment outer housing including a clutch tube, said inner housing and said adjustment outer housing defining an interior region therebetween;

c. a coil spring coupled within an outer surface of said clutch tube of said adjustment outer housing, said coil spring including middle region located between a first spring tine and a second spring tine, said coil spring having a free diameter slightly larger than said outer surface of said clutch tube;

d. an adjustment knob coupled to said adjustment outer housing, said adjustment knob including a first flange and a second flange, said first flange engageable with said first spring tine and said second flange engageable with said second spring tine, wherein said adjustment knob is rotatable in a first direction and a second direction, said first direction opposite said second direction;

e. a pinion coupled within said interior region between said adjustment outer housing and said inner housing and coupled to said adjustment knob, said pinion including a plurality of teeth and a pair of regions, one of said regions engageable with said first spring tine and an other of said pair of regions engageable with said second spring tine; and f. a strap having a middle portion, a first end and a second end;

wherein said first end and said second end each have an open middle region including a plurality of teeth, wherein each of said plurality of teeth of each of said first end and said second end is engaged with a corresponding one of said plurality of teeth of said pinion;

wherein the rotation of said adjustment knob in said first direction causes said first flange to contact said first spring tine to coil said coil spring away from said clutch tube, therein allowing said second flange to contact said one of said regions to move said region in a first direction, wherein the rotation of said one of said regions in said first direction causes said plurality of teeth of said pinion to rotate in said first direction, therein causing said first end of said strap and said second end of said strap to move opposite one another and away from said pinion;

wherein the rotation of said adjustment knob in said second direction causes said second flange to contact said second spring tine to coil said coil spring away from said clutch tube, therein allowing said second flange to contact said other of said regions to move said other of said regions in a first direction, wherein the rotation of said other of said regions in said second direction causes said plurality of teeth of said pinion to rotate in said second direction, therein causing said first end of said strap and said second end of said strap to move opposite one another and towards from said pinion.

19. The adjustment mechanism of claim 18, wherein said first direction is clockwise and wherein said second direction is counterclockwise.

20. The adjustment mechanism of claim 18, wherein said first direction is counterclockwise and wherein said second direction is clockwise.

21. The adjustment mechanism of claim 18, wherein said middle portion of said strap is formed of a flexible, durable tough material; and wherein said ends of said strap are formed of a second material having sufficient hardness to resist breakage associated with engagement of said adjustment mechanism.

22. The adjustment mechanism of claim 21, wherein said flexible, durable tough material is selected from the group consisting of high density polypropylene and high density polyethylene.

23. The adjustment mechanism of claim 21, wherein said second material is selected from the group consisting of nylon and acetal.

24. An adjustment mechanism for a helmet comprising:

a lower rear shell portion including:

a. an inner housing having an adjustment mounting pad;

b. an adjustment outer housing coupled to said inner housing, said adjustment outer housing including a clutch tube, said inner housing and said adjustment outer housing defining an interior region therebetween;

c. a coil spring coupled within an outer surface of said clutch tube of said adjustment outer housing, said coil spring including middle region located between a first spring tine and a second spring tine, said coil spring having a free diameter slightly larger than said outer surface of said clutch tube;

d. an adjustment knob coupled to said adjustment outer housing, said adjustment knob including a first flange and a second flange, said first flange engageable with said first spring tine and said second flange engageable with said second spring tine, wherein said adjustment knob is rotatable in a first direction and a second direction, said first direction opposite said second direction;

e. a pinion coupled within said interior region between said adjustment outer housing and said inner housing and coupled to said adjustment knob, said pinion including a plurality of teeth and a pair of regions, one of said regions engageable with said first spring tine and an other of said pair of regions engageable with said second spring tine;

f. a first strap having a middle portion, a first end and a second end; and g. a second strap having a middle portion, a first end and a second end;

wherein said first end of said first strap and said second end of said second strap each have an open middle region including a plurality of teeth, wherein each of said plurality of teeth of each of said first end of said first strap and said second end of said second strap are each engaged with a corresponding one of said plurality of teeth of said pinion;

wherein the rotation of said adjustment knob in said first direction causes said first flange to contact said first spring tine to coil said coil spring away from said clutch tube, therein allowing said second flange to contact said one of said regions to move said region in a first direction, wherein the rotation of said one of said regions in said first direction causes said plurality of teeth of said pinion to rotate in said first direction, therein causing said first end of said first strap and said second end of said second strap to move opposite one another and away from said pinion;

wherein the rotation of said adjustment knob in said second direction causes said second flange to contact said second spring tine to coil said coil spring away from said clutch tube, therein allowing said second flange to contact said other of said regions to move said other of said regions in a first direction, wherein the rotation of said other of said regions in said second direction causes said plurality of teeth of said pinion to rotate in said second direction, therein causing said first end of said first strap and said second end of said second strap to move opposite one another and towards from said pinion.

25. The adjustment mechanism of claim 24, wherein said first direction is clockwise and wherein said second direction is counterclockwise.

26. The adjustment mechanism of claim 24, wherein said first direction is counterclockwise and wherein said second direction is clockwise.

27. The adjustment mechanism of claim 24, wherein said middle portion of said first strap and the said middle portion of said second strap are each formed of a flexible, durable tough material; and, wherein said ends of each of said first strap and said second strap are formed of a second material having sufficient hardness to resist breakage associated with engagement of said adjustment mechanism.

28. The adjustment mechanism of claim 27, wherein said flexible, durable tough material is selected from the group consisting of high density polypropylene and high density polyethylene.

29. The adjustment mechanism of claim 27, wherein said second material is selected from the group consisting of nylon and acetal.

30. A protective helmet comprising:

a shell adapted to provide protection for a wearer's head;

a lining joined with the shell, the lining at least partially defining an interior region adapted to receive a wearer's head;

a strap circumferentiating at least a portion of the interior region, the strap including a middle portion, a first end, and a second end, the strap adapted to grip the wearer's head;

an adjustment mechanism joined with the first and second ends of the strap, the adjustment mechanism configured to move the first and second ends, thereby at least one of tightening and loosening the strap about the wearer's head, the adjustment mechanism including:

an adjustment knob rotatable in a first direction and a second, opposite direction, the adjustment knob including at least one flange;

a pinion element positioned adjacent the adjustment knob, the pinion element engaging the first and second ends of the strap, the pinion element adapted to be selectively rotated by the adjustment knob about a common axis so that the pinion element moves the first and second ends of the strap, the pinion element including a pinion projection extending therefrom;

a clutch element aligned with the adjustment knob and the pinion element along the common axis, a coil spring being positioned adjacent the clutch element, the coil spring having a plurality of coils and including a first tine extending from at least one of the coils, the first tine of the coil spring positioned between the flange and the pinion projection, wherein the flange of the adjustment knob is moveable to engage and move the first tine so that the coil spring disengages the clutch element so that the flange of the adjustment knob can further move to subsequently move the pinion projection, thereby rotating the pinion element about the common axis so that the pinion element moves the first and second ends of the strap to at least one of tighten and loosen the strap about the wearer's head, thereby changing a dimension of the interior region.

31. The protective helmet of claim 30 comprising wherein the adjustment knob includes first and second flanges, the first and second flanges positioned on opposing first and second sides of the pinion projection so that the pinion projection is located between the first and second flanges.

32. The protective helmet of claim 31 wherein the coil spring includes a second tine projecting therefrom, the second tine adjacent and adapted to engage the second side of the pinion projection.

33. The protective helmet of claim 32 wherein the first tine is positioned between the first flange and first side of the pinion projection, and wherein the second tine is positioned between the second flange and the second side of the pinion projection.

34. The protective helmet of claim 1 wherein said coil spring includes a tine, wherein said adjustment knob engages said tine when said adjustment knob is rotated.

35. The protective helmet of claim 1 wherein the diameter of the spring reduces in dimension to disengage from the clutch element when the coil spring moves away from the clutch element.

* * * * *